US007559618B2

(12) United States Patent
Oh et al.

(10) Patent No.: US 7,559,618 B2
(45) Date of Patent: Jul. 14, 2009

(54) SCANNING TYPE INKJET IMAGE FORMING APPARATUS

(75) Inventors: Sang-mi Oh, Suwon-si (KR); Jung-hwan Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 218 days.

(21) Appl. No.: 11/444,408

(22) Filed: Jun. 1, 2006

(65) Prior Publication Data

US 2006/0274101 A1 Dec. 7, 2006

(30) Foreign Application Priority Data

Jun. 1, 2005 (KR) ..... 10-2005-0046740

(51) Int. Cl.
*B41J 2/205* (2006.01)

(52) U.S. Cl. ..... 347/15; 347/41

(58) Field of Classification Search ..... 347/12, 347/40, 43, 42, 49, 13, 15, 41
See application file for complete search history.

(56) References Cited

U.S. PATENT DOCUMENTS 6,439,687 B1 8/2002 Inoue
6,644,783 B1 * 11/2003 Tsuruoka ..... 347/41

FOREIGN PATENT DOCUMENTS

| | | |
|---|---|---|
| JP | 02-059349 | 2/1990 |
| JP | 09-174843 | 7/1997 |
| JP | 10-016253 | 1/1998 |
| JP | 2000-071433 | 3/2000 |
| JP | 2001-232781 | 8/2001 |
| JP | 2002-103604 | 4/2002 |
| JP | 2002-301816 | 10/2002 |
| JP | 2003-205615 | 7/2003 |
| KR | 2001-28853 | 4/2001 |

OTHER PUBLICATIONS

Korean Office Action dated Jul. 11, 2007 issued in KR 2005-46740.

* cited by examiner

*Primary Examiner*—Lamson D Nguyen
(74) *Attorney, Agent, or Firm*—Stanzione & Kim LLP

(57) ABSTRACT

A scanning type inkjet image forming apparatus. The inkjet image forming apparatus includes a printhead having at least one nozzle group having a plurality of nozzles, a driving unit to drive the plurality of nozzles to print an image, and a controller to generate control signals to drive the driving unit so as to drive the nozzles of the at least one nozzle group and to drive the nozzles in a plurality of nozzle blocks time-divisionally, wherein the controller drives the nozzles of the at least one nozzle group and the nozzles of the nozzle blocks in the same direction.

9 Claims, 15 Drawing Sheets

SCANNING TYPE INKJET IMAGE FORMING APPARATUS

CROSS-REFERENCE TO RELATED APPLICATIONS

This application claims the benefit of Korean Patent Application No. 10-2005-0046740, filed on Jun. 1, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to a scanning type inkjet image forming apparatus which performs a printing operation with high resolution.

2. Description of the Related Art

A scanning type inkjet image forming apparatus forms an image by ejecting ink from a printhead that reciprocates in a direction that is perpendicular to a feeding direction of a print medium while being spaced apart from a top side of the printing medium by a predetermined gap. A printing quality is a very important factor in the scanning type inkjet image forming apparatus. Japanese Patent Laid-open Publication No. 2001-232781 describes a conventional inkjet image forming apparatus that enhances printing quality.

FIG. 1 illustrates ink dots ejected on a print medium P using the conventional inkjet image forming apparatus of Japanese Patent Laid-open Publication No. 2001-232781. FIG. 2 illustrates ink dots ejected on another print medium P using the conventional inkjet image forming apparatus. FIG. 3 illustrates ink dots ejected on another print medium P using the conventional inkjet image forming apparatus. In addition, FIG. 4 is an enlarged view of a portion of a print region of the printing mediums P of FIGS. 2 and 3.

A printhead 20 having a plurality of nozzles N1 to NN extending along a width of the print medium P in a direction that is perpendicular to a print medium-feeding direction (X-direction) is illustrated in FIG. 1. When the plurality of nozzles N1 to NN are sequentially driven, a deviation degree W that corresponds to a distance between a dot DD1 and a dot DDN is generated on the print medium P Here, the deviation degree W is a difference between positions of the dot DD1 ejected from a first nozzle N1 and the dot DDN ejected from an N-th nozzle NN. As the deviation degree W increases, ink is not ejected to a correct position and is ejected further from the other ink dots such that an image quality is lowered. The deviation degree W can be reduced using the following methods: as illustrated in FIG. 2, ink is ejected by dividing a plurality of head chips 21 into blocks so that each of the blocks is placed in a reverse order (i.e., alternating between a first direction and a second direction), or as illustrated in FIG. 3, ink is ejected by disposing the plurality of head chips 21 in a zigzag pattern so that each of the head chips 21 is placed in the reverse order. Thus, when time-division driving is performed in the reverse order, as illustrated in FIG. 4, the deviation degree W can be reduced. However, two ink dots are ejected to a predetermined region 10 and ink dots are not ejected to another region 30 so that a blank region that corresponds to the region 30 exists. Thus, a difference in optical density between the region 10 where ink dots are ejected to overlap and the region 30 where ink dots are not ejected occurs so that the image quality is lowered. This is a problem in the conventional inkjet image forming apparatus that attempts to print high quality images. Accordingly, an inkjet image forming apparatus having an improved structure becomes necessary.

SUMMARY OF THE INVENTION

The present general inventive concept provides an inkjet image forming apparatus having an improved structure in which a difference in deviation degree between ink dots generated by time-division driving is minimized, thereby improving a printing quality.

The present general inventive concept also provides an inkjet image forming apparatus which improves a printing quality by preventing regions printed to by adjacent nozzles from overlapping.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing an inkjet image forming apparatus, the inkjet image forming apparatus including a printhead having at least one nozzle group including a plurality of nozzles, a driving unit to drive the plurality of nozzles to print an image, and a controller to generate control signals to drive the driving unit so as to drive the plurality of nozzles of the at least one nozzle group and to time dimensionally drive the nozzles in the at least one nozzle group in a plurality of nozzle blocks, wherein the controller drives the nozzles of the at least one nozzle group and the nozzles of the nozzle blocks in the same direction.

The inkjet image forming apparatus may further include a carriage on which the printhead is mounted to move in a main scanning direction and to print an image, wherein the printhead prints to the same printed area moving two or more times repeatedly.

The controller may generate control signals to determine an order in which to drive the nozzles of the at least one nozzle group and the nozzles of the nozzle blocks so that patterns printed by driving the nozzles of the at least one nozzle group and patterns printed by driving the nozzles of the nozzle blocks form slanted lines having the same slope.

The controller may generate control signals so that the patterns printed by driving the nozzles of the nozzle blocks are symmetrical with one another based on the patterns printed by driving the nozzles of the at least one nozzle group.

The controller may generate control signals so that the nozzles of the at least one nozzle group are driven in one direction when the printhead performs a first printing operation.

The driving unit may include a thermal driving type driving unit.

The driving unit may include a piezoelectric type driving unit.

The nozzles of the at least one nozzle group may be disposed to be parallel in a subsidiary scanning direction.

The at least one nozzle group may be disposed in a zigzag pattern in a subsidiary scanning direction.

The foregoing and/or other aspects of the present general inventive concept are also achieved by providing an inkjet image forming apparatus, the inkjet image forming apparatus including at least one nozzle group having a plurality of nozzles that are arrangeable in two or more nozzle blocks, a printhead having the at least one nozzle group, a driving unit to drive the nozzles to print an image, and a controller to generate control signals to drive the driving unit so as to drive the nozzles of the at least one nozzle group and to drive the nozzles in the two or more nozzle blocks time-divisionally, wherein the controller drives the nozzles of the at least one nozzle group and the nozzles of the two or more nozzle blocks in the same direction.

The inkjet image forming apparatus may further include a carriage on which the printhead is mounted to move in a main scanning direction and to print an image, wherein the printhead prints to the same printed area moving two or more times repeatedly.

The controller may generate control signals to sequentially drive the nozzles of the at least one nozzle group from a first nozzle to an N-th nozzle during a first printing operation, and to drive one of the two or more nozzle blocks and then driving the other of the two or more nozzle blocks during a second printing operation.

The controller may generate control signals to determine an order in which to drive the nozzles of the at least one nozzle group and the nozzles of the two or more nozzle blocks so that patterns printed during the first printing operation and patterns printed during the second printing operation form slanted lines having the same slope.

The foregoing and/or other aspects of the present general inventive concept are also achieved by providing an inkjet image forming apparatus, the inkjet image forming apparatus including a first nozzle group having N nozzles, a second nozzle group disposed to be parallel with the first nozzle group and having L nozzles, a printhead having at least the first nozzle group and the second nozzle group, a driving unit to drive the N nozzles and the L nozzles to print an image, and a controller to generate control signals to drive the driving unit so as to drive the nozzles N and L of the first and second nozzle groups and to drive the N nozzles and the L nozzles in a plurality of nozzle blocks time-divisionally, wherein the controller drives the nozzles N and L of the first and second nozzle groups and the nozzles of the plurality of nozzle blocks in the same direction.

The inkjet image forming apparatus may further include a carriage on which the printhead is mounted to move in a main scanning direction and to print an image, wherein the printhead prints to the same printed area moving two or more times repeatedly.

The controller may generate control signals to drive the driving unit so as to sequentially drive the nozzles N of the first nozzle group from a first nozzle to an N-th nozzle, and to drive the nozzles L of the second nozzle group in M nozzle blocks.

The controller may generate control signals to determine an order in which to drive the nozzles N of the first nozzle group and the nozzles L of the M nozzle blocks so that patterns printed by driving the nozzles N of the first nozzle group and patterns printed by driving the nozzles L of the M nozzle blocks form slanted lines having the same slope.

The nozzles N and L of the first and second nozzle groups may be disposed to be parallel in a subsidiary scanning direction.

The first and second nozzle groups may be disposed in a zigzag pattern in a subsidiary scanning direction.

The foregoing and/or other aspects of the present general inventive concept are also achieved by providing an inkjet image forming apparatus, comprising a print head unit having a plurality of nozzles extending along a first axis thereof and to reciprocate over a print medium, and a controller to control the print head unit to perform a first printing operation to sequentially eject ink from the plurality of nozzles in a line in a first direction along the first axis, and to control the print head unit to perform a second printing operation to sequentially eject ink from at least a first block of the plurality of nozzles and at least a second block of the plurality of nozzles in the line in the first direction along the first axis.

The foregoing and/or other aspects of the present general inventive concept are also achieved by providing an inkjet image forming apparatus, comprising a print head unit having a plurality of nozzles that are divisible into at least a first nozzle block and a second nozzle block extending along a first axis thereof and to reciprocate over a print medium, and a controller to control the print head unit to perform a first printing operation to sequentially eject ink from the first nozzle block and the second nozzle block in a line in a first direction along the first axis, and to control the print head unit to perform a second printing operation to sequentially eject ink from the second nozzle block and the first nozzle block in the line in the first direction along the first axis.

The foregoing and/or other aspects of the present general inventive concept are also achieved by providing an inkjet image forming apparatus, comprising a print head unit having a plurality of nozzles, and a controller to reciprocate the print head unit in a predetermined reciprocation direction over a print medium, to control the print head unit to perform a first print operation using a first sequence of the plurality of nozzles in a predetermined ejection direction, and to control the print head unit to perform a second print operation using a second sequence of the plurality of nozzles in the same predetermined ejection direction.

The foregoing and/or other aspects of the present general inventive concept are also achieved by providing an inkjet image forming apparatus, comprising a print head unit including at least a first nozzle group and a second nozzle group each having corresponding pluralities of nozzles extending along a length of the print head unit, and a controller to reciprocate the print head unit over a print medium, to control the first nozzle group to eject ink in a first sequence of the plurality of nozzles in a predetermined sequence direction of the print head unit, to control the second nozzle group to eject ink in a second sequence of the corresponding plurality of nozzles in the predetermined sequence direction of the print head unit, and the first sequence is different from the second sequence.

The foregoing and/or other aspects of the present general inventive concept are also achieved by providing a method of controlling an inkjet image forming apparatus including a print head unit having a plurality of nozzles, the method comprising reciprocating the print head unit in a predetermined reciprocation direction over a print medium, controlling the print head unit to perform a first print operation using a first sequence of the plurality of nozzles in a predetermined ejection direction, and controlling the print head unit to perform a second print operation using a second sequence of the plurality of nozzles in the same predetermined ejection direction.

The foregoing and/or other aspects of the present general inventive concept are also achieved by providing a method of controlling an inkjet image forming apparatus including a print head unit having a plurality of nozzles that are divisible into at least a first nozzle block and a second nozzle block extending along a first axis thereof and to reciprocate over a print medium, the method comprising controlling the print head unit to perform a first printing operation to sequentially eject ink from the first nozzle block and the second nozzle block in a line in a first direction along the first axis, and controlling the print head unit to perform a second printing operation to sequentially eject ink from the second nozzle block and the first nozzle block in the line in the first direction along the first axis.

The foregoing and/or other aspects of the present general inventive concept are also achieved by providing a computer readable medium containing executable code to control an inkjet image forming apparatus including a print head unit having a plurality of nozzles, the method comprising a first executable code to reciprocate the print head unit in a predetermined reciprocation direction over a print medium, a second executable code to control the print head unit to perform a first print operation using a first sequence of the plurality of nozzles in a predetermined ejection direction, and a third executable code to control the print head unit to perform a second print operation using a second sequence of the plurality of nozzles in the same predetermined ejection direction.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
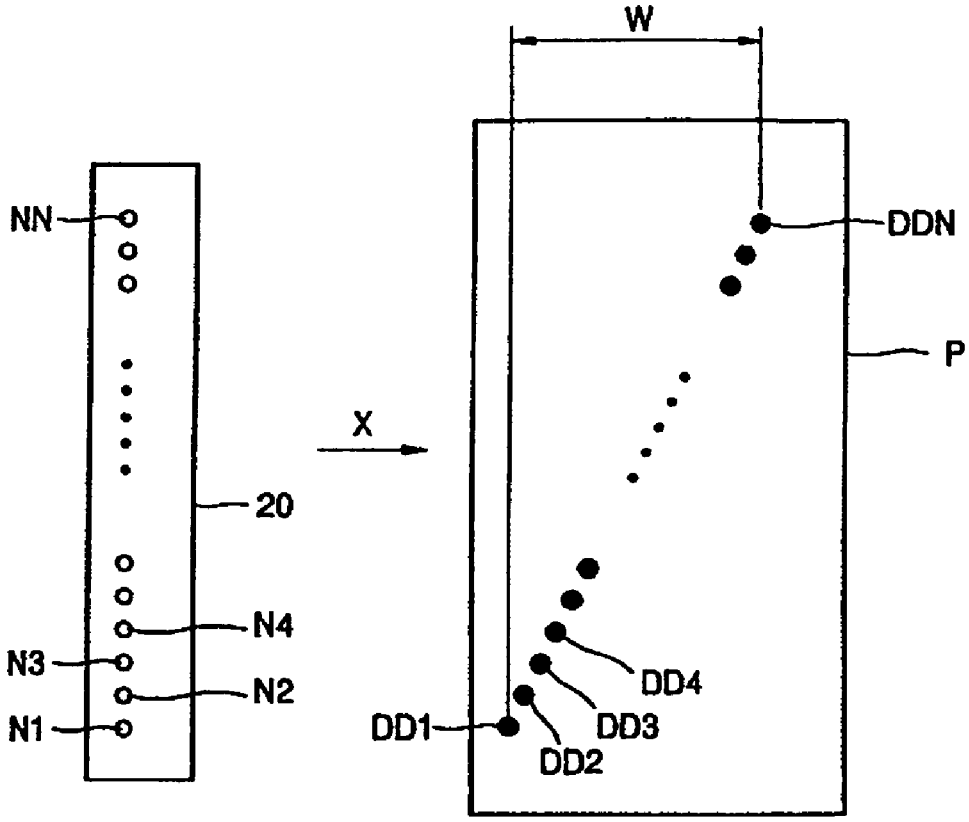
FIG. 1 (PRIOR ART)
FIG. 1 illustrates ink dots ejected on a print medium using a conventional inkjet image forming apparatus.
Figure 2:
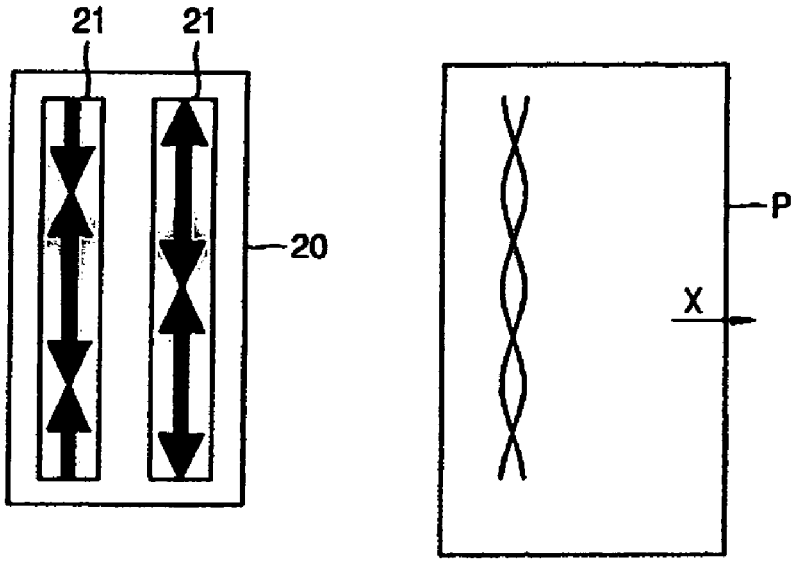
FIG. 2 (PRIOR ART)
FIG. 2 illustrates ink dots ejected on another print medium using the conventional image forming apparatus.
Figure 3:
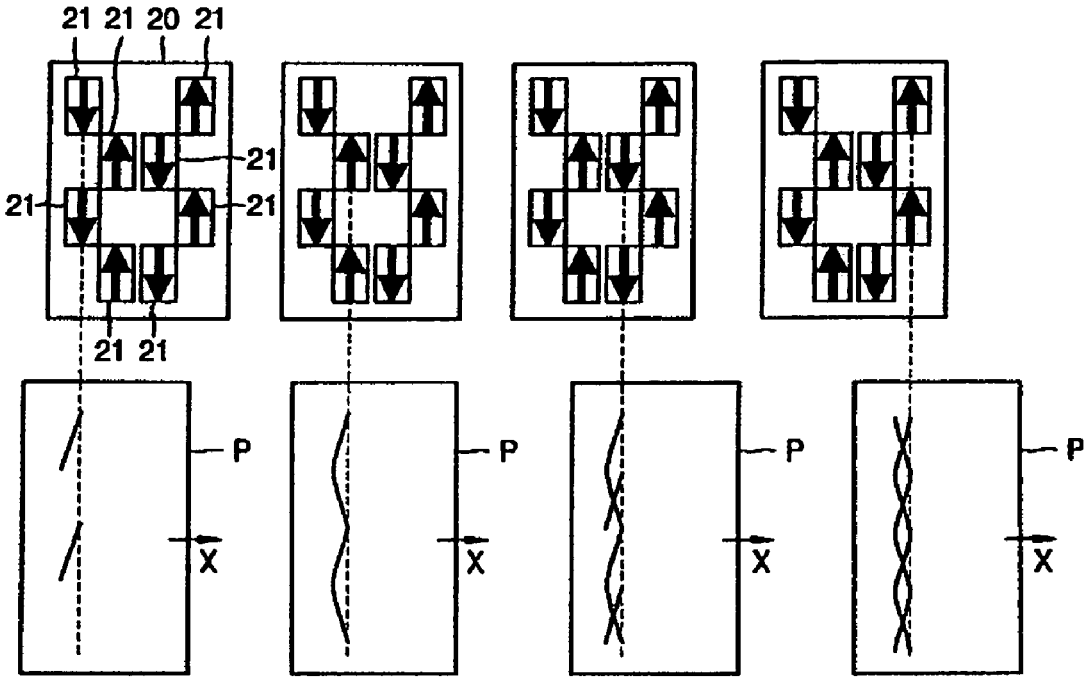
FIG. 3 (PRIOR ART)
FIG. 3 illustrates ink dots ejected on another print medium using the conventional image forming apparatus.
Figure 4:
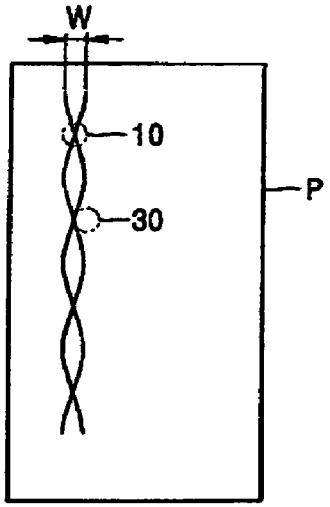
FIG. 4 (PRIOR ART)
FIG. 4 is an enlarged view of a portion of a print region of the print mediums of FIGS. 2 and 3.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the FIGS.

Figure 5:
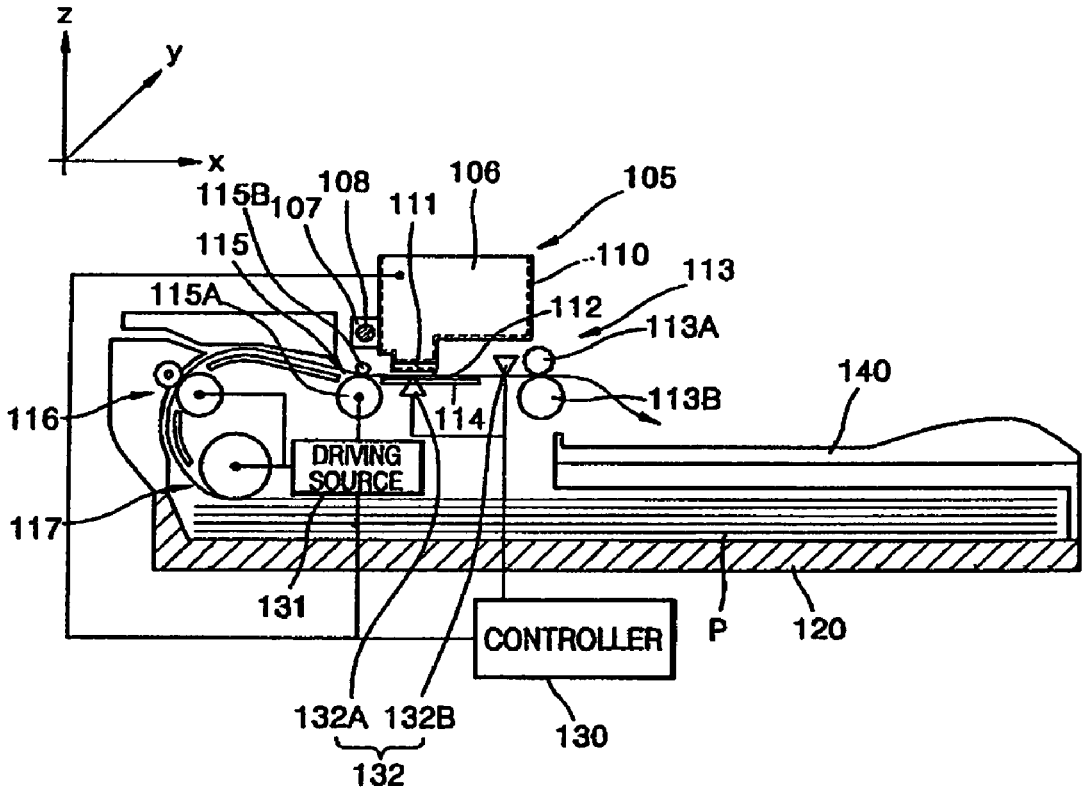
FIG. 5 is a schematic view illustrating a scanning type inkjet image forming apparatus according to an embodiment of the present general inventive concept.

FIG. 5 is a schematic view illustrating a scanning type inkjet image forming apparatus according to an embodiment of the present general inventive concept. Referring to FIG. 5, the scanning type inkjet image forming apparatus includes a paper feeding cassette 120, a printhead unit 105, a support member 114 that faces the printhead unit 105, a plurality of print medium-feeding units 113, 115, 116, and 117 that feed a print medium P in a subsidiary scanning direction, and a stacking unit 140 on which a discharged print medium P is stacked.

The print medium P is stacked on the paper feeding cassette 120. The print medium P stacked on the paper feeding cassette 120 is fed to a printhead 111 by the print medium-feeding units 113, 115, 116, and 117, which are described below. In FIG. 5, the print medium P is fed in an x-direction, which is the subsidiary scanning direction, and the printhead 111 moves in a y-direction, which is a main scanning direction. The subsidiary scanning direction and the main scanning direction may be perpendicular to each other. Alternatively, the subsidiary scanning direction and the main scanning direction may be inclined at a predetermined angle with respect to each other.

The print medium-feeding units 113, 115, 116, and 117 feed the print medium P that is stacked on the paper feeding cassette 120 along a predetermined path. In FIG. 5, the print medium-feeding units 113, 115, 116, and 117 include a pickup roller 117, a feeding roller 115, and a paper discharging roller 113. The print medium-feeding units 113, 115, 116, and 117 are driven by a driving source 131 such as a motor and provide a force to feed the print medium P. Operation of the driving source 131 is controlled by a controller 130, which is described below.

The pickup roller 117 is installed at one side of the paper feeding cassette 120 and picks up the print medium P that is stacked on the paper feeding cassette 120 one by one, thereby withdrawing the print medium P from the paper feeding cassette 120. The pickup roller 117 is rotated while pressing a top side of the print medium P, thereby feeding the print medium P outside of the paper feeding cassette 120.

The feeding roller 115 is installed at an inlet side of the printhead 111 and feeds the print medium P withdrawn by the pickup roller 117 to the printhead 111. In this case, the feeding roller 115 can align the print medium P so that ink can be ejected onto a desired portion of the print medium P, before the print medium P is transferred to the printhead 111. The feeding roller 115 includes a driving roller 11 5A that provides a feeding force to feed the print medium P and an idle roller 115B elastically engaged with the driving roller 115A. An auxiliary roller 116 that feeds the print medium P can be further installed between the pickup roller 117 and the feeding roller 115.

The paper discharging roller 113 is installed at an outlet side of the printhead 111 and discharges the print medium P on which a printing operation has been completed, outside of the scanning type image forming apparatus. The print medium P that is discharged outside of the scanning type image forming apparatus is stacked on the stacking unit 140. The paper discharging roller 113 includes a star wheel 113A installed in a widthwise direction along the print medium P and a support roller 113B that faces the star wheel 11 3A and supports a rear side of the print medium P. The print medium P includes a top side having wet ink that is ejected by the printhead 111, which reciprocates along the main scanning direction. The print medium P may wrinkle before it is transferred past the printhead 111. If the wrinkling is severe, the print medium P contacts a nozzle unit 112 or a bottom surface of a body 110, undried ink is spread (i.e., smeared) on the print medium P, and an image printed thereon may be contaminated. In addition, due to the wrinkling, there is a high probability that a distance between the print medium P and the nozzle unit 112 may not be maintained. The star wheel 113A is used to prevent the print medium P fed in a downward direction of the nozzle unit 112 from contacting the nozzle unit 112 or the bottom surface of the body 110, and to prevent the distance between the print medium P and the nozzle unit 112 from varying. At least a part of the star wheel 113A is installed to protrude further downward than in the nozzle unit 112 and makes point contact with the top side of the print medium P. According to the above structure, the star wheel 113A makes point contact with the top side of the print medium P so that an ink image that has been ejected on the top side of the print medium P, and has not yet dried, is prevented from being contaminated. In addition, a plurality of star wheels may be installed so as to feed the print medium P smoothly. When the plurality of star wheels are installed to be parallel to a feeding direction of the print medium P, a plurality of support rollers that correspond to the plurality of star wheels may be provided.

In addition, when the printing operation is consecutively performed on a plurality of sheets of the print medium P, the print medium P is discharged and stacked on the stacking unit 140 and then, a next print medium P is discharged before ink ejected on the top side of the print medium P is dried, and a rear side of the next print medium P may be contaminated. To prevent this potential problem, an additional drying device (not shown) may be further provided.

The support member 114 is disposed below the printhead 111 so that a predetermined distance between the nozzle unit 112 and the print medium P can be maintained, and supports the rear side of the print medium P. The distance between the nozzle unit 112 and the print medium P may be about 0.5-2.5 mm.

A sensing unit 132 senses whether or not a defective nozzle exists in the nozzle unit 112 disposed under the printhead 111. Here, the defective nozzle may be a damaged nozzle or a weak nozzle that cannot eject ink properly. That is, the defective nozzle occurs when ink is not ejected from nozzles due to a variety of causes or when a smaller amount of ink droplet is ejected.

The sensing unit 132 includes a first sensing unit 132A that senses whether or not a defective nozzle exists in the nozzle unit 112 before the printing operation starts and a second sensing unit 132B that senses whether or not a defective nozzle exists in the nozzle unit 112 while the printing operation is performed. The first sensing unit 132A senses whether or not nozzles are clogged by radiating light directly onto the nozzle unit 112, and the second sensing unit 132B senses whether or not a defective nozzle exists in the nozzle unit 112 by radiating light onto the print medium P that is being fed.

The second sensing unit 132B may be an optical sensor including a light-emitting sensor such as a light emitting diode that radiates light onto the print medium P and a light-receiving sensor that receives light reflected from the print medium P The light-emitting sensor and the light-receiving sensor may be formed as a single body or in a separate shape. The structure and operation of the optical sensor should be known to those skilled in the art, and thus, a detailed description thereof will not be provided.

The printhead unit 105 prints an image by ejecting ink onto the print medium P The printhead unit 105 includes the body 110, the printhead 111 disposed on the bottom surface of the body 110, the nozzle unit 112 disposed under the printhead 111, and a carriage 106 on which the body 110 is mounted to reciprocate in the main scanning direction (i.e., the y-direction). The body 110 having the printhead 111 is mounted in a cartridge shape on the carriage 106, and a carriage moving unit 142 (see FIG. 6), which is described below, and reciprocates the carriage 106 in the main scanning direction. The feeding roller 115 is installed at the inlet side of the nozzle unit 112, and the paper discharging roller 113 is installed at the outlet side of the nozzle unit 112. In addition, a cable transmits a driving signal generated by the controller 130, which is described below, including power to eject ink, print data, or the like to nozzles of the nozzle unit 112. In this case, a flexible cable such as a flexible printed circuit (FPC) or a flexible flat cable (FFC) may be used.

Figure 6:
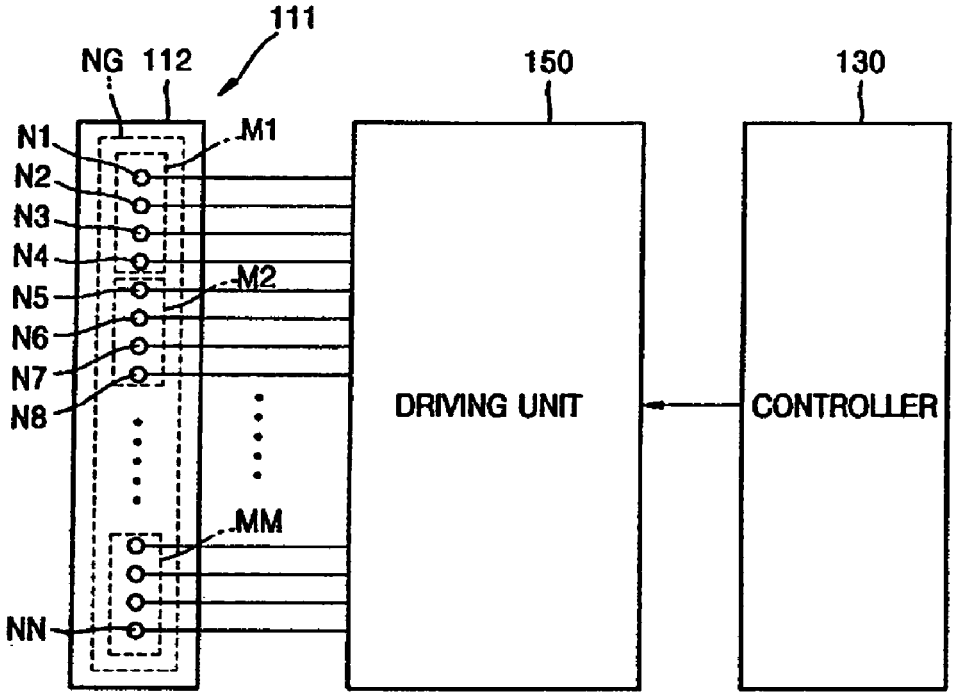
FIG. 6 is a view illustrating a printhead of the scanning type inkjet image forming apparatus of FIG. 5 according to an embodiment of the present general inventive concept.

FIG. 6 is a view illustrating the printhead 111 of the scanning type image forming apparatus of FIG. 5 according to an embodiment of the present general inventive concept. In FIG. 6, reference numerals N1, N2, N3, N4, . . . , and NN represent the nozzles, reference numeral NG represents a nozzle group, and reference numerals M1, M2, . . . , and MM represent nozzles divided into blocks in each nozzle group.

Referring to FIG. 6, the printhead 111 includes N nozzle units 112 disposed in the subsidiary scanning direction (i.e., the x-direction). The printhead 111 prints an image by ejecting ink onto the print medium P while making a reciprocating motion in the main scanning direction (i.e., the y-direction). The printhead 111 uses thermal energy, a piezoelectric device, or the like as a power source to eject the ink, and the printhead 111 is manufactured to have a high resolution using a semiconductor manufacturing processes such as etching, deposition, and sputtering, and the like. The printhead 111 may eject one color or two or more colors.

The nozzle unit 112 includes at least one nozzle group NG. N nozzles N1, N2, N3, N4, . . . , and NN to print an image by ejecting ink onto the print medium P are disposed in each nozzle group NG. N nozzles N1, N2, N3, N4, . . . , and NN in each nozzle group NG are divided into M blocks M1, M2, . . . , and MM so that time-division driving can be performed. That is, the N nozzles N1, N2, N3, N4, . . . , and NN and the M blocks M1, M2, . . . , and MM of each nozzle group NG are time-divisionally driven independently by a driving unit 150 that is described below. Here, a number of nozzles of each nozzle group NG and a number of nozzles of the M blocks may be different. In addition, although the nozzle unit 112 illustrated in FIG. 6 includes the N nozzles N1, N2, N3, N4, . . . , and NN arranged in a straight line, it should be understood that the N nozzles N1, N2, N3, N4, . . . , and NN may be arranged in a zigzag pattern in two or more lines so as to improve the resolution.

Although not shown, a storage space in which ink is to be stored is disposed in the body 110. An ink-storing space is formed in a cartridge shape in the body 110 to be attachable and detachable therefrom. The body 110 may further include a chamber having the driving unit 150 in communication with each of nozzles N1, N2, N3, N4, . . . , and NN of the nozzle unit 112 and to apply pressure to eject the ink (e.g., piezoelectric device and a thermal driving heater) a passage such as an orifice to supply ink received in the body 110 to the chamber, a manifold that is a common passage to supply ink that flows in via the passage to the chamber, and a restrictor which is a separate passage to supply ink to each chamber from the manifold, and/or the like. The chamber, the passage, the manifold, the restrictor, and the like should be known to those skilled in the art, and thus, a detailed description thereof will not be provided.

The driving unit 150 supplies an ejecting force and time-divisionally drives the N nozzles N1, N2, N3, . . . , and NN of each nozzle group NG and the N nozzles N1, N2, N3, . . . , and NN-may be divided into the M blocks M1, M2, . . . , and MM and driven, thereby printing an image. The driving unit 150 may be classified according to a type of actuator that supplies the ejecting force to the ink droplets. The driving unit 150 may be a thermal driving type that generates bubbles in the ink using a heater to eject the ink droplets using an expansion force of the bubbles, or a piezoelectric device type that ejects the ink droplets using pressure applied to the ink due to deformation of a piezoelectric device. As described above, the driving unit 150 selectively drives the N nozzles N1, N2, N3, N4, . . . , and NN and the M blocks M1, M2, . . . , and MM, thereby printing the image. In this case, the ejecting operation of the nozzle unit 112, that is, the ejecting operations of the N nozzles N1, N2, N3, N4, . . . , and NN and the M blocks M1, M2, . . . , and MM are controlled by the controller 130, which is described below.

Figure 7:
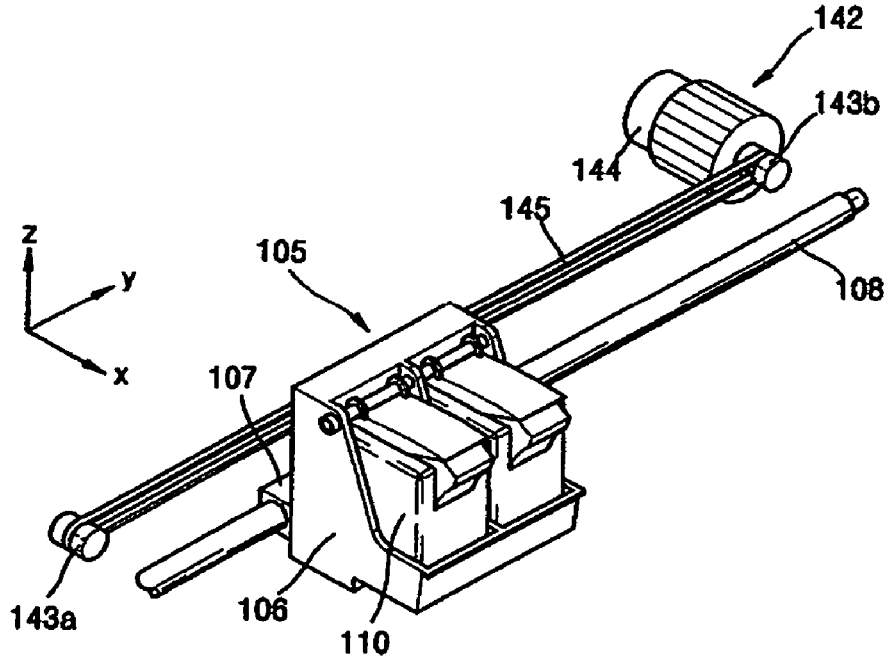
FIG. 7 is a perspective view of a printhead unit and a carriage moving unit of the scanning type inkjet image forming apparatus of FIG. 5 according to an embodiment of the present general inventive concept.

FIG. 7 is a perspective view of the printhead unit 105 and the carriage moving unit 142 of the scanning type image forming apparatus of FIG. 5 according to an embodiment of the present general inventive concept. Referring to FIGS. 5 and 7, the body 110 is mounted on the carriage 106. The printhead 111 is mounted on the carriage 106 in a cartridge shape connected to the body 110. The carriage moving unit 142 allows the carriage 106 to make a reciprocating motion in the main scanning direction and includes a carriage moving motor 144, carriage moving rollers 143*a* and 143*b*, and a carriage moving belt 145. A power from a main body of the scanning type image forming apparatus is supplied to the carriage moving motor 144. One side of each of the carriage moving rollers 143*a* and 143*b* is connected to the carriage moving motor 144, and the other side thereof is installed on a main frame (not shown). The carriage moving belt 145 is supported by the carriage moving rollers 143*a* and 143*b* and is transferred therearound, endlessly. The carriage 106 is combined with the carriage moving belt 145. The carriage 106 moves to a predetermined position in response to a control signal transmitted from the controller 130, which is described below, to the carriage moving motor 144. The reciprocating motion of the carriage 106 is guided by a guide shaft 108. The guide shaft 108 guides the reciprocating motion of the carriage 106 driven by the carriage moving motor 144. A combining unit 107, into which the guide shaft 108 is inserted, is disposed at one side of the carriage 106. The combining unit 107 is perforated at one side of the carriage 106. The guide shaft 108 is inserted into the combining unit 107 that is formed in a hollow shape and guides the reciprocating motion of the carriage 106.

Figure 8:
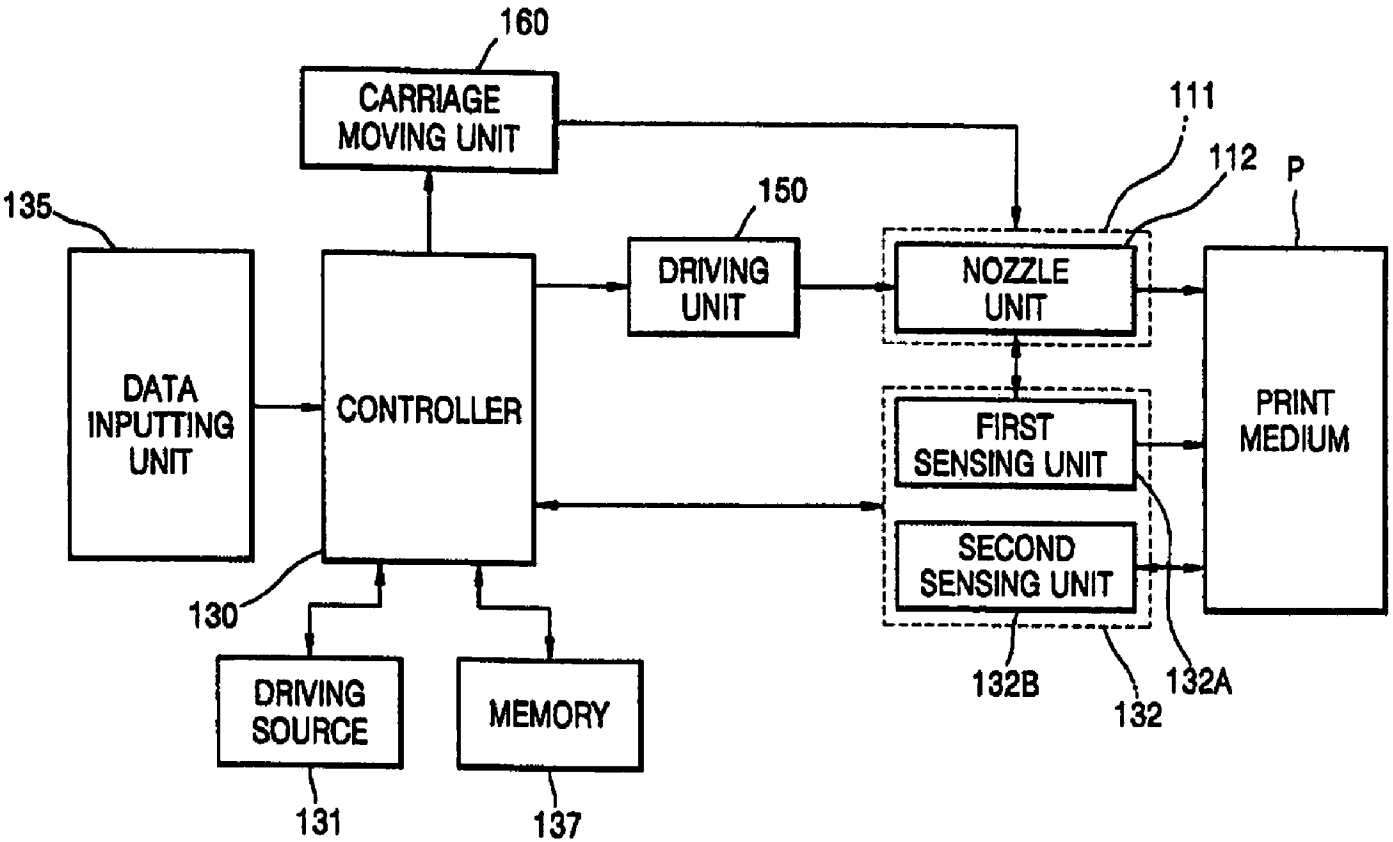
FIG. 8 is a block diagram illustrating operation of the scanning type inkjet image forming apparatus according to another embodiment of the present general inventive concept.

FIG. 8 is a block diagram illustrating operation of the scanning type inkjet image forming apparatus of FIG. 5 according to another embodiment of the present general inventive concept.

Referring to FIGS. 5 to 8, a data inputting unit 135 is a host system such as a personal computer (PC), a digital camera, or a personal digital assistant (PDA). Image data to be printed is input to the data inputting unit 135 in an order that corresponds to pages to be printed. The data inputting unit 135 includes an application program, a graphics device interface (GDI), an image forming apparatus driver, a user interface, and a spooler.

The scanning type image forming apparatus includes a video controller (not shown) and the controller 130. The video controller interprets and bitmaps commands generated by the image forming apparatus driver, and then transmits the interpreted commands to the controller 130. The controller 130 transmits the bitmap generated by the video controller to each element of the scanning type image forming apparatus, thereby forming an image on the print medium P. The printing operation is then performed in the scanning type image forming apparatus using the above-described procedure.

Referring to FIG. 8, the controller 130 may be disposed on a motherboard of the scanning type image forming apparatus and controls an ejecting operation of the nozzle unit 112 disposed under the printhead 111, an operation of the print medium-feeding units 113, 115, 116, and 117 (see FIG. 5), and an operation of the carriage 106 (see FIGS. 5 and 7). That is, the controller 130 synchronizes the operation of each element of the scanning type image forming apparatus so that ink is ejected from the nozzle unit 112 that moves in the main scanning direction when the printing operation to a predetermined portion of the print medium P with a predetermined resolution. The controller 130 stores the image data input through the data inputting unit 135 in a memory 137 and checks whether the image data to be printed has been completely stored in the memory 137.

If the image data has been completely stored, the controller 130 operates the driving source 131 by generating a control signal that corresponds to a printing environment. The print medium P is fed by the print medium-feeding units 113, 115, 116, and 117 (see FIG. 5) that are driven by the driving source 131. The print medium P that is withdrawn by the pickup roller 117 is transferred to the nozzle unit 112. The controller 130 moves the printhead 111 in the main scanning direction, thereby printing an image.

The controller 130 generates control signals to control the ejecting operation of the nozzle unit 112, and the nozzle unit 112 prints the image data on the print medium P in response to the control signals. That is, as illustrated in FIG. 6, the controller 130 controls the driving unit 150 and time-divisionally drives the N nozzles N1, N2, N3, . . . , and NN of each nozzle group NG, and the N nozzles N1, N2, N3, . . . , and NN divided into the M blocks M1, M2, . . . , and MM are driven. In this case, the controller 130 drives the N nozzles N1, N2, N3, . . . , and NN of each nozzle group NG and the N nozzles N1, N2, N3, . . . , and NN divided into the M blocks M1, M2, . . . , and MM in the same direction (as opposed to the conventional inkjet image forming apparatus described with reference to FIGS. 1 to 4). In addition, the controller 130 controls the operation of the printhead 111 so that the printhead 111 prints to the same printed area by moving two or more times repeatedly over the printed area.

In order to minimize a difference in a deviation degree generated by time-division driving and to prevent a printed area printed to by a nozzle from overlapping with a printed area printed to by an adjacent nozzle, the controller 130 generates control signals to determine an order in which to drive the nozzles of the nozzle group NG and the nozzles of the M blocks M1, M2, . . . , and MM so that patterns printed by driving the nozzles of the nozzle group NG and patterns printed by driving the nozzles of the M blocks M1, M2, . . . , and MM form a slanted line having the same slope. In this case, the controller 130 may generate the control signals so that the patterns printed by driving the nozzles of the M blocks M1, M2, . . . , and MM are symmetrical with one another based on the patterns printed by driving the nozzles of the nozzle group NG. Alternatively, the controller 130 may generate the control signals to drive the nozzles of the nozzle group NG in one direction and to print when the printhead 111 performs a printing operation for the first time.

Print patterns according to an embodiment of the present general inventive concept will now be described in order to illustrate the various embodiments of the present general inventive concept. A case in which one nozzle group including N nozzles is time-divisionally driven into two blocks will be described first. In addition, the printhead 111 prints to the same print area twice.

Figure 9:
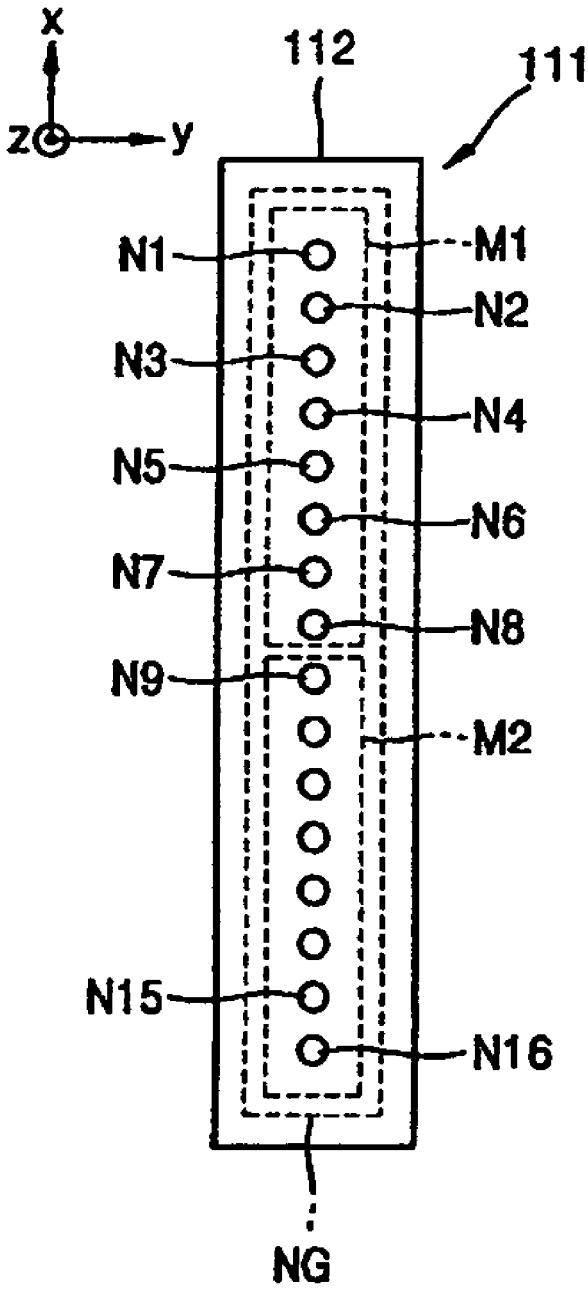
FIG. 9 illustrates the printhead of FIG. 6 according to an embodiment of the present general inventive concept.
Figure 10A:
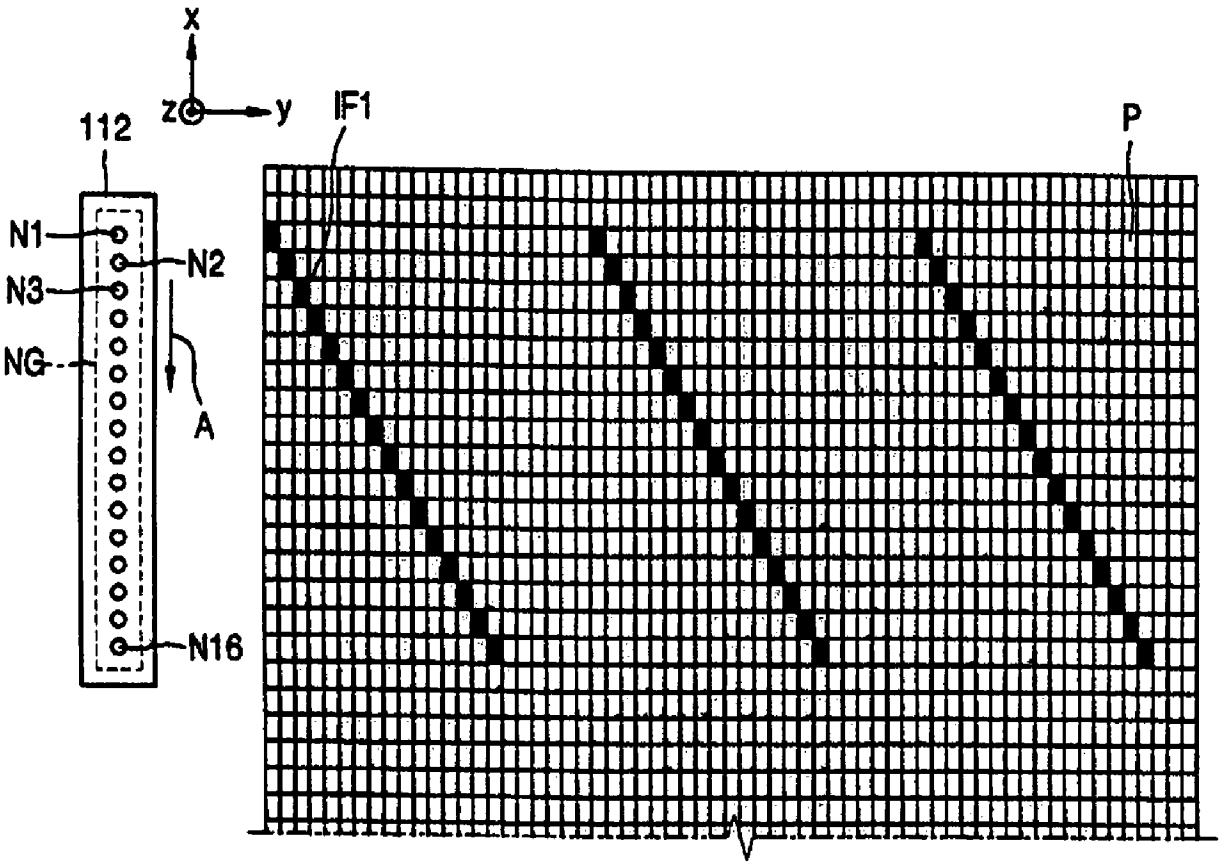
FIG. 10A illustrates print patterns printed when the printhead of FIG. 9 performs a first scanning operation in one direction according to an embodiment of the present general inventive concept.
Figure 10B:
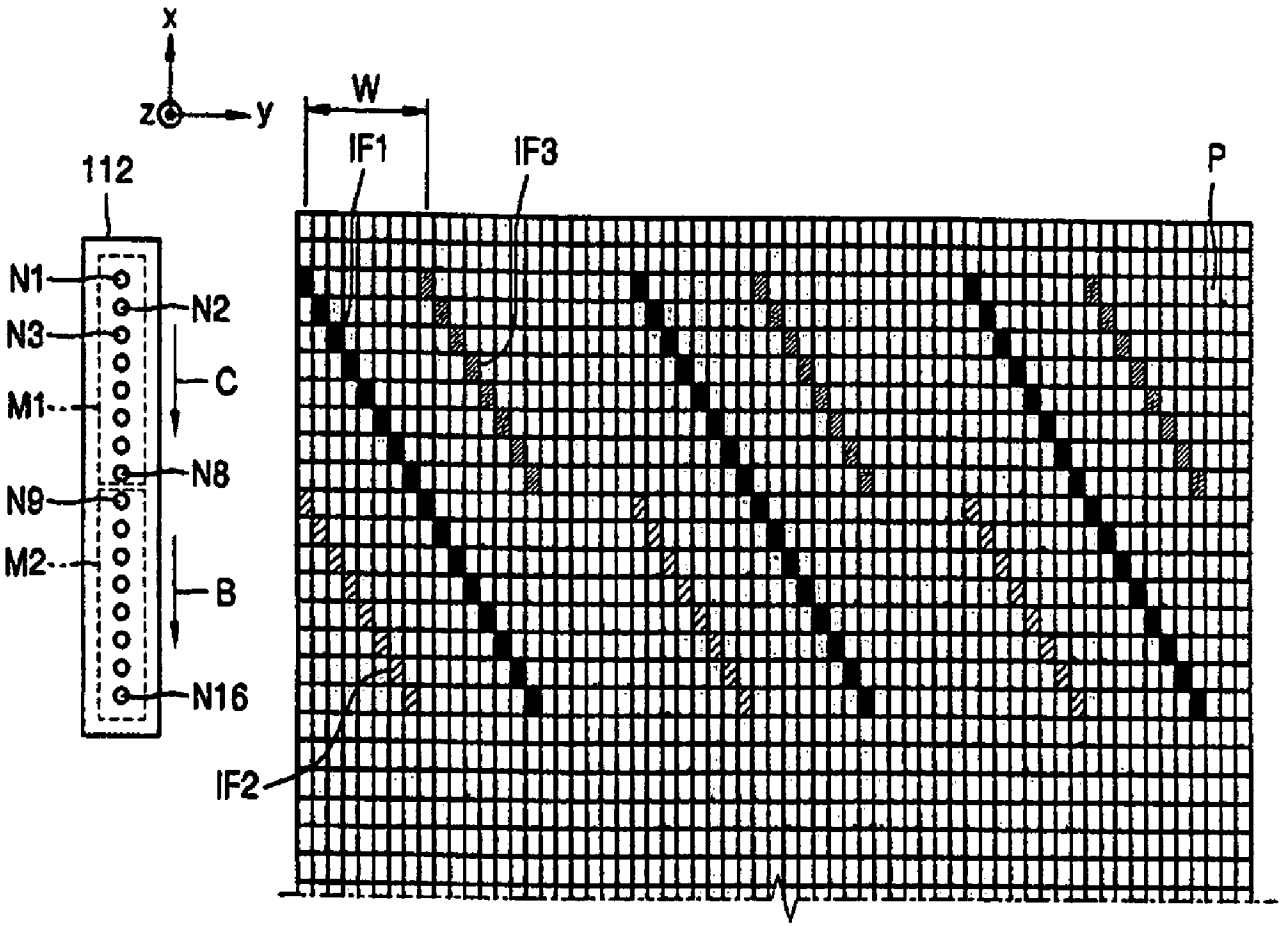
FIG. 10B illustrates print patterns printed when the printhead of FIG. 9 performs a second scanning operation after the first scanning operation of FIG. 10A according to an embodiment of the present general inventive concept.

FIG. 9 illustrates the printhead 111 of FIG. 6 according to an embodiment of the present general inventive concept, FIG. 10A illustrates print patterns printed when the printhead 111 of FIG. 9 performs a first scanning operation in one direction, and FIG. 10B illustrates print patterns printed when the printhead 111 of FIG. 9 performs a second scanning operation after the first scanning operation of FIG. 10A. In addition, FIG. 11A illustrates print patterns printed when the printhead 111 of FIG. 9 performs a first scanning operation in another direction, and FIG. 11B illustrates print patterns printed when the printhead 111 performs a second scanning operation after the first scanning operation of FIG. 11A.

Referring to FIG. 9, the nozzle unit 112 includes one nozzle group NG. The nozzle group NG includes 16 nozzles, and the 16 nozzles are time-divisionally driven as a first block M1 and a second block M2. The first block M1 includes first to eighth nozzles N1 to N8, and the second block M2 includes ninth to sixteenth nozzles N9 to N16. Although FIG. 9 illustrates that the nozzle unit 112 has one nozzle group NG with two blocks Ml and M2, each including eight nozzles, it should be understood that the nozzle unit 112 may have a variety of other arrangements including any number of nozzle groups, blocks, and/or nozzles. In addition, the printhead 111 moves in the main scanning direction (i.e., y-direction), prints an image, prints to the same print area at least twice, repeatedly. In this case, the print medium P may be fed under the nozzle unit 112 and stopped under the nozzle unit 112, repeatedly.

As illustrated in FIG. 10A, the controller 130 sequentially drives the first nozzle N1 to sixteenth nozzle N16 of the nozzle group NG in a direction of arrow A when the first printing operation is performed (i.e., during the first scanning operation). Since the printhead 111 moves along the main scanning direction (i.e., the y-direction) and ejects ink droplets onto the stopped print medium P, ink dots IF1 that are ejected onto the print medium P are formed along a slanted line having a predetermined slope. If the first scanning operation has been completely performed, the printhead 111 moves to its original location (e.g. at a left side of the print medium P). As illustrated in FIG. 10B, the controller 130 drives at least one of the two blocks M1 and M2 and then drives the other block when the second printing operation is performed (i.e., during the second scanning operation). In the present embodiment, the second block M2 is driven first and then the first block M1 is driven second. That is, the controller 130 sequentially drives the ninth nozzle N9 to the sixteenth nozzle N16 of the second block M2 in a direction of arrow B, and then sequentially drives the first nozzle N1 to the eighth nozzle. N8 of the first block M1 in a direction of arrow C. Thus, ink dots IF2 that are ejected onto the print medium P by the second block M2 during the second printing operation and ink dots IF3 that are ejected onto the print medium P by the first block M1 during the second printing operation are formed along a slanted line having a predetermined slope. In this case, the controller 130 may drive the nozzle group NG and the two blocks M1 and M2 so that the ink dots IF1 ejected during the first printing operation and the ink dots IF2 and IF3 ejected during the second printing operation form a slanted line having the same slope, as illustrated in FIG. 10B. The controller 130 feeds the print medium P by a predetermined distance before printing to a next region, and then repeatedly performs the above-described operations, thereby printing an image. If the nozzle group NG and the two blocks M1 and M2 are driven using the above-described operations, a difference in a deviation degree W that occurs by time-division driving can be visually minimized and ink dots ejected by adjacent nozzles can be prevented from overlapping. In other words, all the nozzles N1 to N16 can be used in a first printing operation while the printhead 111 moves in the y-direction (left to right), then the second block M2 can be driven before the first block M1 during the second printing operation while the printhead 111 moves again in the y-direction (left to right). Accordingly, the printhead 111 moves in the y-direction over the same print area twice without overlapping ink ejections.

Figure 11A:
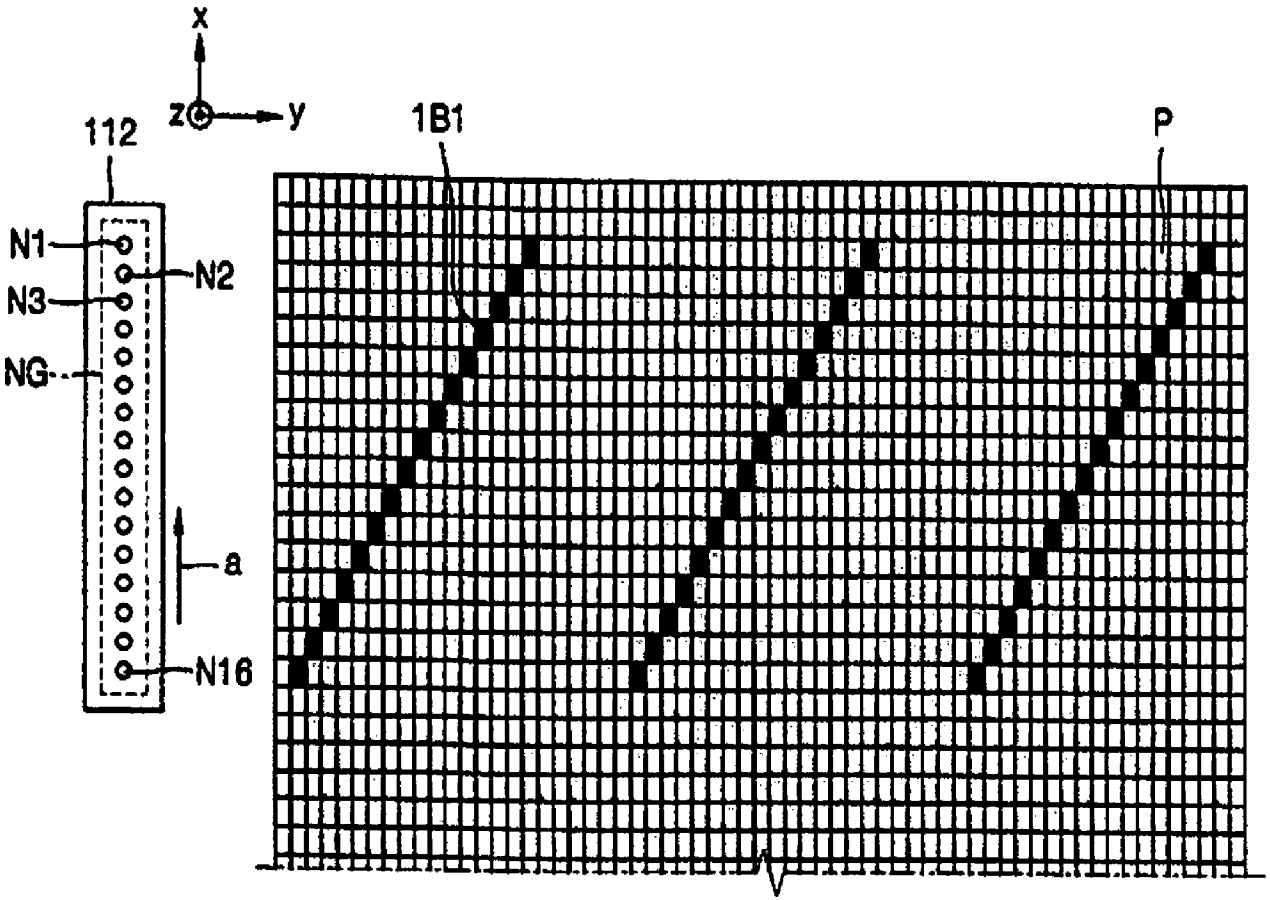
FIG. 11A illustrates print patterns printed when the printhead of FIG. 9 performs a first scanning operation in another direction according to another embodiment of the present general inventive concept.
Figure 11B:
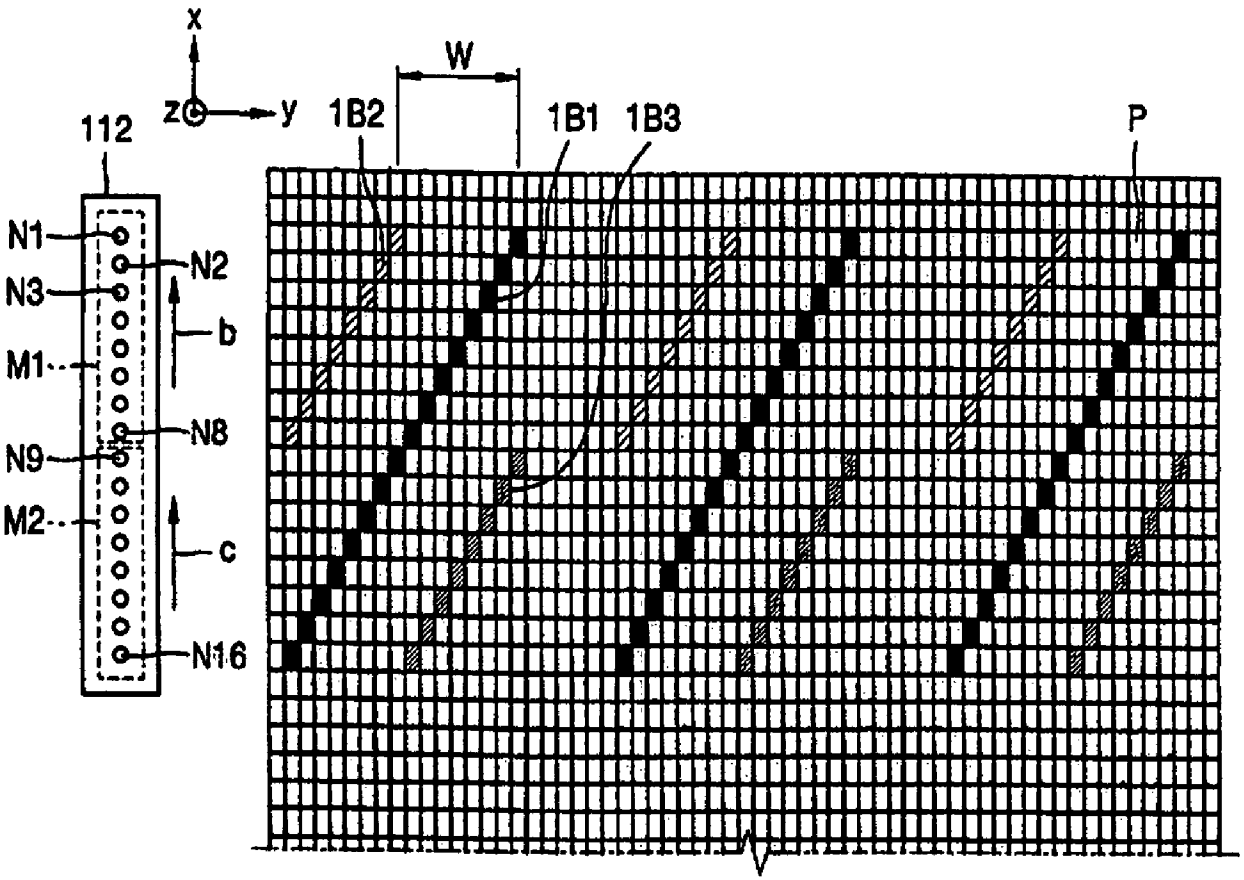
FIG. 11B illustrates print patterns printed when the printhead of FIG. 9 performs a second scanning operation after the first scanning operation of FIG. 11A according to another embodiment of the present general inventive concept.

Referring to FIGS. 11A and 11B, the controller 130 sequentially drives the sixteenth nozzle N16 to the first nozzle N1 of the nozzle group NG in a direction of arrow a when the first printing operation is performed (i.e., during the first scanning operation). Since the printhead 111 moves in the main scanning direction (i.e., the y-direction) and ejects ink droplets onto the stopped print medium P, ink dots 1B1 ejected onto the print medium P are formed along a slanted line having a predetermined slope. If the first scanning operation has been completely performed, the printhead 111 moves to its original location (e.g. at a left side of the print medium P). As illustrated in FIG. 11B, the controller 130 drives one of two blocks M1 and M2 and then drives the other block when the second printing operation is performed (i.e., during the second scanning operation). In the present embodiment, the first block M1 is driven and then the second block M2 is driven. That is, the controller 130 sequentially drives the eighth nozzle N8 to the first nozzle N1 of the first block M1 in a direction of arrow b, and then sequentially drives the sixteenth nozzle N16 to the ninth nozzle N9 of the second block M2 in a direction of arrow c (i.e., the same direction as the arrow b). Thus, ink dots 1B2 ejected onto the print medium P by the first block M1 during the second printing operation and ink dots 1B3 ejected onto the print medium P by the second block M2 during the second printing operation are formed along a slanted line having the predetermined slope. In this case, the controller 130 may drive the entire nozzle group NG and the two blocks M1 and M2 so that the ink dots 1B1 ejected during the first printing operation and the ink dots 1 B2 and 1 B3 ejected during the second printing operation form a slanted line having the same slope, as illustrated in FIG. 11B. The controller 130 then feeds the print medium P by the predetermined distance before printing to the next region, and then repeatedly performs the above-described operations, thereby printing an image. If the entire nozzle group NG and the two blocks M1 and M2 are driven using the above-described operations, a difference in the deviation degree W that occurs by time-division driving can be visually minimized and ink dots ejected by adjacent nozzles can be prevented from overlapping. The controller 130 controls the printhead 111 to reciprocate in the y-direction along the print medium P (e.g. left to right) two times, one time for each printing operation. Accordingly, the printhead 111 moves over the same print area twice without overlapping ink ejections. It should be understood that more than two printing operations may alternatively be performed. In this case, the printhead 111 may reciprocate over the same print area more than two times.

Figure 12:
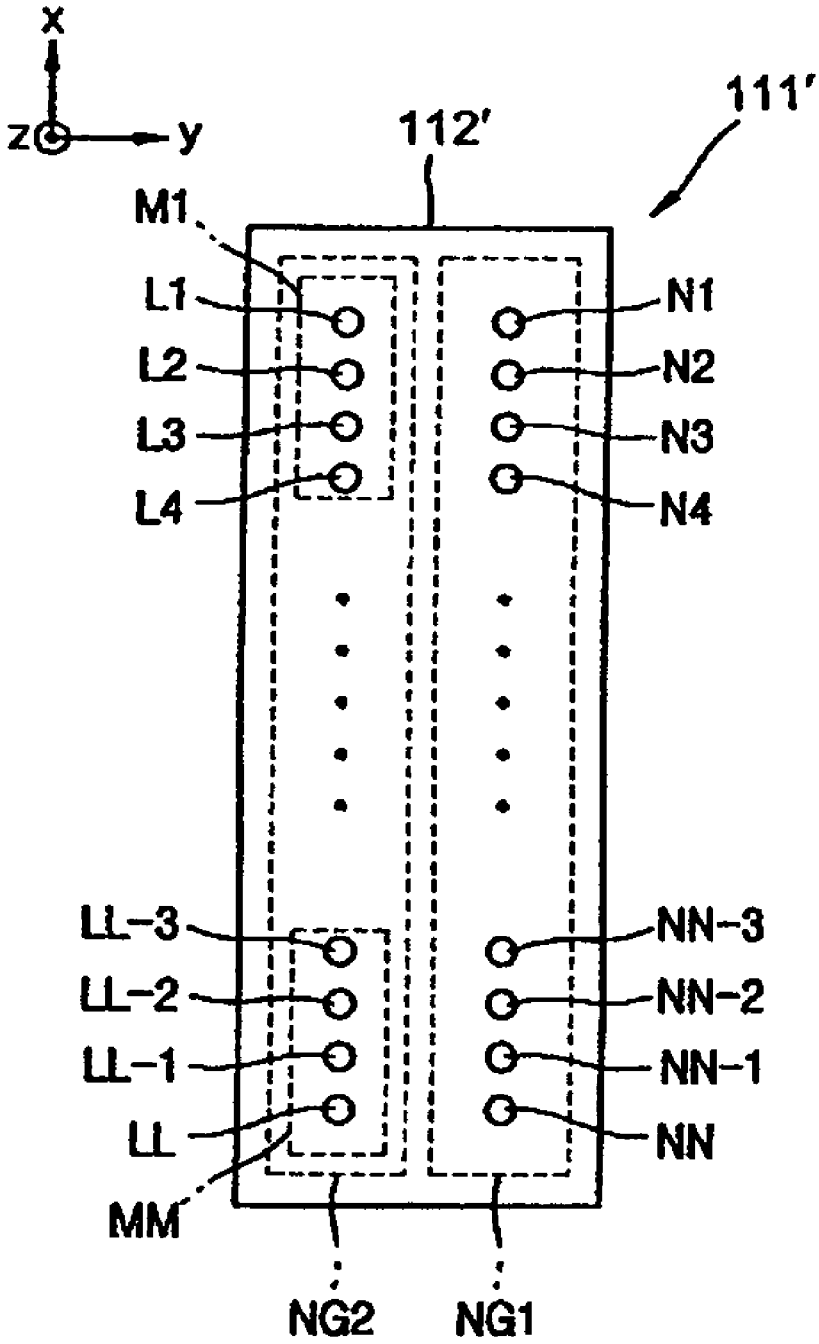
FIG. 12 illustrates a printhead according to another embodiment of the present general inventive concept.

FIG. 12 illustrates a printhead 111' according to another embodiment of the present general inventive concept. In FIG. 12, reference numeral NG1 represents a first nozzle group, reference numeral NG2 represents a second nozzle group, reference numerals N1, N2, N3, N4, . . . , and NN represent nozzles of the first nozzle group NG1, reference numerals L1, L2, L3, L4, . . . , and LL represent nozzles of the second nozzle group NG2, and reference numerals M1, . . . , and MM represent nozzles divided into blocks in the second nozzle group NG2. The structure and operation of the present embodiment are similar to those of the printhead 111 of FIGS. 6 through 11, and thus, some of the description thereof will not be provided. In addition, similar components of the printheads 111 and 111' are represented using like reference numerals. The structure and operation of the first nozzle group NG1 and the second nozzle group NG2 may be reversed.

Referring to FIG. 12, the printhead 111' includes a nozzle unit 112' disposed in a subsidiary scanning direction (i.e., an x-direction). The printhead 111' prints an image by ejecting ink onto the print medium P while making a reciprocating motion in a main scanning direction (i.e., y-direction). The nozzle unit 112' includes at least one first nozzle group NG1 and a second nozzle group NG2 disposed to be parallel to the first nozzle group NG1. N nozzles N1, N2, N3, N4, . . . , and NN to print an image by ejecting ink onto the print medium P are disposed in the first nozzle group NG1, and L nozzles L1, L2, L3, L4, . . . , and LL are disposed in the second nozzle group NG2. In addition, the first and second nozzle groups NG1 and NG2 may be divided into a plurality of blocks. Here, a number of nozzles of the first nozzle group NG1 and a number of nozzles of the second nozzle group NG2 may be the same. In addition, although the nozzles N1, N2, N3, N4, . . . , and NN of the first nozzle group NG1 and the nozzles L1, L2, L3, L4, . . . , and LL of the second nozzle group NG2 illustrated in FIG. 12 are disposed to be parallel in a straight line, it should be understood that the nozzles of the first and second nozzle groups NG1 and NG2 may alternatively be disposed in a zigzag pattern so as to improve a resolution.

The controller 130 time-divisionally drives the N nozzles N1, N2, N3, . . . , and NN of the first nozzle group NG1, the L nozzles L1, L2, L3, . . . , and LL of the second nozzle group NG2, and the plurality of blocks M1 to MM. In this case, an order in which to drive the nozzles of the first and second nozzle groups NG1 and NG2 and an order in which to drive the plurality of nozzles is in the same direction (as opposed to the conventional inkjet image forming apparatus described with reference to FIGS. 1 to 4). In addition, the controller 130 controls the operation of the printhead 111' so as to print to the same print area by moving in the y-direction one or more times, repeatedly.

The controller 130 may time-divisionally drive the L nozzles L1, L2, L3, L4, . . . , and LL of the second nozzle group NG2 into M blocks M1, . . . , and MM. In order to minimize a difference in a deviation degree generated by the time-division driving and to prevent ink ejected from a nozzle from overlapping with ink ejected by an adjacent nozzle, the controller 130 may sequentially drive the nozzles of the first nozzle group NG1 from the first nozzle N1 to the N-th nozzle NN and may drive the nozzles of the second nozzle group NG2 in M blocks time-divisionally. For example, the controller 130 may generate a control signal to determine the order in which to drive nozzles of the first nozzle group NG1 and nozzles of the M blocks M1, M2, . . . , and MM so that patterns that are printed by driving the nozzles of the first nozzle group NG1 and patterns that are printed by driving the nozzles of the M blocks M1, M2, . . . , and MM form a slanted line having the same slope.

Print patterns according to another embodiment of the present general inventive concept will now be described.

Figure 13:
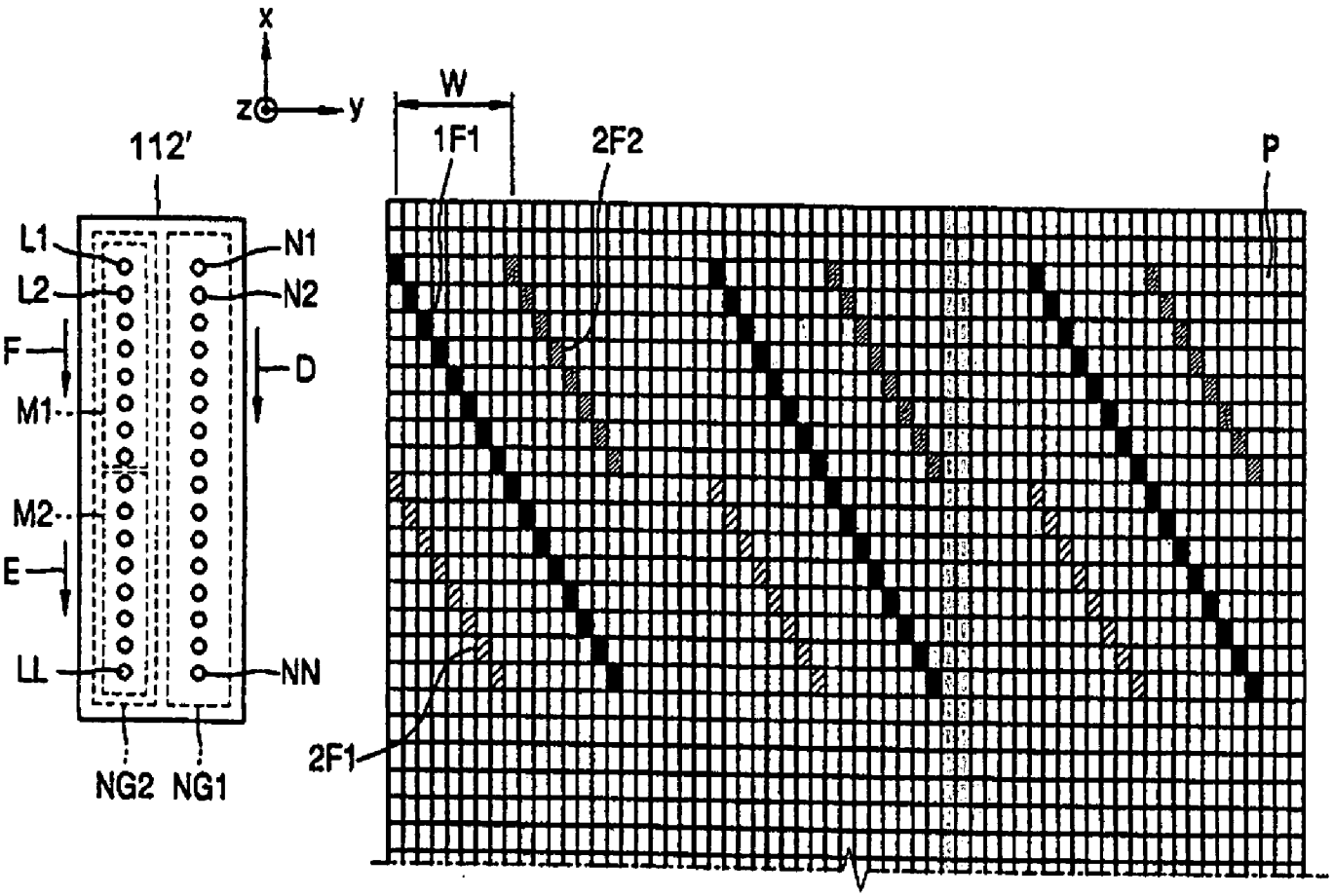
FIG. 13 illustrates print patterns printed when the printhead of FIG. 12 performs a scanning operation in one direction according to an embodiment of the present general inventive concept.
Figure 14:
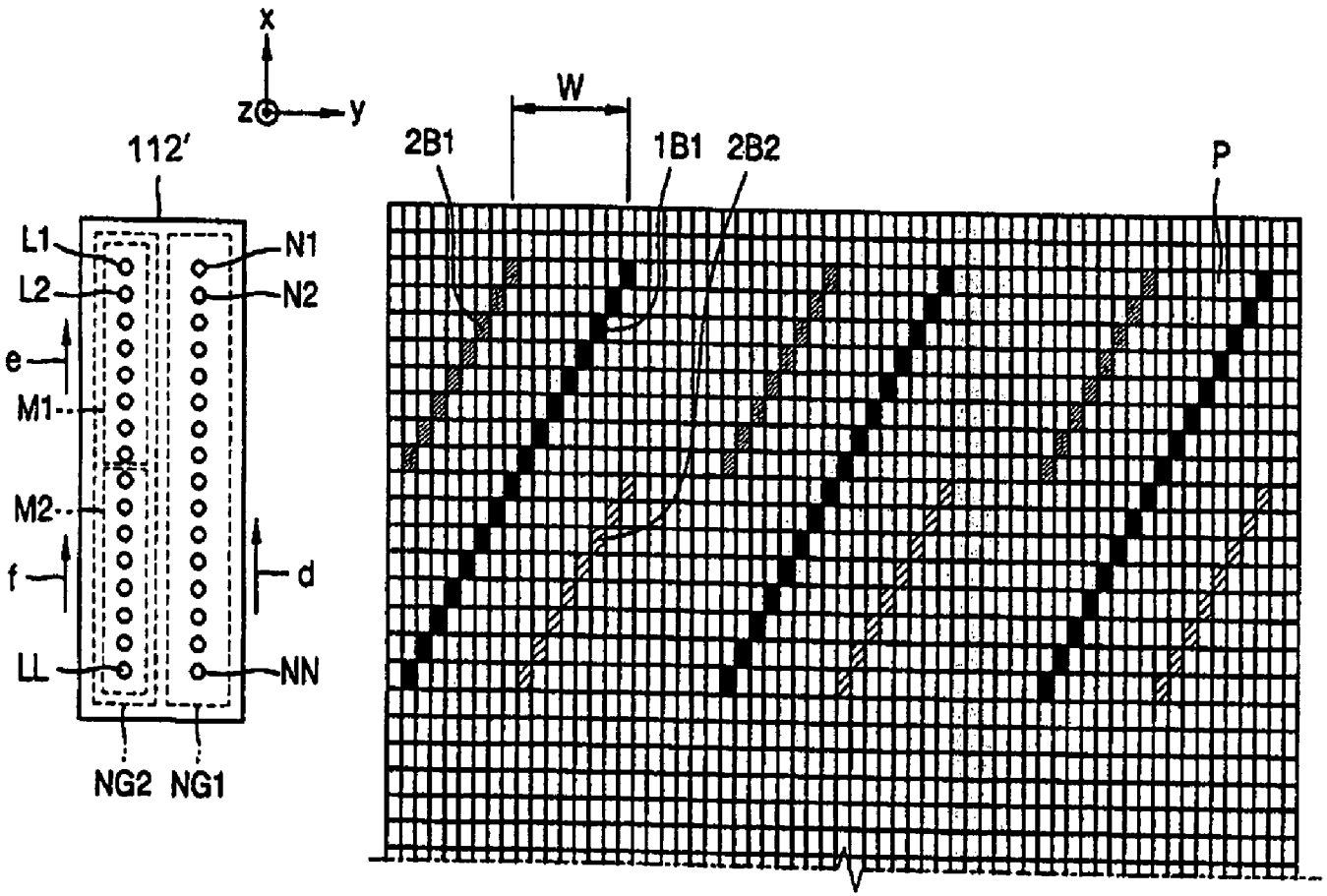
FIG. 14 illustrates print patterns printed when the printhead of FIG. 12 performs a scanning operation in another direction according to an embodiment of the present general inventive concept.

FIG. 13 illustrates print patterns printed when the printhead 111' of FIG. 12 performs a scanning operation in one direction, and FIG. 14 illustrates print patterns printed when the printhead 111' of FIG. 12 performs a scanning operation in another direction. The first and second nozzle groups NG1 and NG2 include 16 nozzles, and the second nozzle group NG2 is time-divisionally driven as the first block M1 and the second block M2. The first block M1 may include the first nozzle L1 to the eighth nozzle L8, and the second block M2 may include the ninth nozzle L9 to the sixteenth nozzle L6. It should be understood that this description, however, is not intended to limit the arrangements of nozzles in the nozzle unit 112'. Other arrangements of nozzles may alternatively be used in the printhead 111'. In addition, the printhead 111' moves in the main scanning direction (i.e., y-direction), prints an image, and prints to the same print area once. Since the printhead 111' has two nozzle groups, the printhead 111' can achieve similar results obtained with the printhead 111 of FIG. 9, without reciprocating over the same print area more than once. After a printing operation in a predetermined area has been completely performed, the print medium P is repeatedly fed and stopped.

Referring to FIG. 13, the controller 130 time-divisionally drives the first nozzle group NG1 and the second nozzle group NG2. That is, the controller 130 sequentially drives the first nozzle N1 to the sixteenth nozzle N16 of the first nozzle group NG1. Since the printhead 111 moves in the main scanning direction (i.e., y-direction) and ejects ink droplets onto the stopped print medium P, ink dots 1F1 ejected onto the print medium P are formed along a slanted line having a predetermined slope. In addition, the controller 130 drives one of two blocks M1 and M2 of the second nozzle group NG2 and then drives the other block. In the present embodiment, the first nozzle group NG1 and the second nozzle group NG2 may be driven simultaneously in one printing operation. In the present embodiment, the second block M2 is driven and then the first block M1 is driven. That is, the controller 130 sequentially drives the ninth nozzle L9 to the sixteenth nozzle L16 of the second block M2 in a direction of arrow B, and then sequentially drives the first nozzle L1 to the eighth nozzle L8 of the first block M1 in a direction of arrow C. Thus, ink dots 2F1 ejected onto the print medium P by the second block M2 and ink dots 2F2 ejected onto the print medium P by the first block M1 are formed along a slanted line having the predetermined slope. In this case, the controller 130 may drive the first nozzle group NG1 and the second nozzle group NG2 so that the ink dots 1F1 by time-division driving of the first nozzle group NG1 and the ink dots 2F1 and 2F2 by time-division driving of the second nozzle group NG2 form a slanted line having the same slope, as illustrated in FIG. 13. The controller 130 feeds the print medium P by a predetermined distance before printing to a next region and then repeatedly performs the above-described operations, thereby printing an image. If the first nozzle group NG1 and the second nozzle group NG2 are driven using the above-described operations, a difference in a deviation degree W produced by time-division driving can be visually minimized and the ink dots ejected by adjacent nozzles can be prevented from overlapping.

Referring to FIG. 14, the controller 130 drives the first nozzle group NG1 and the second nozzle group NG2 in a direction opposite to the direction illustrated in FIG. 13. That is, the controller 130 sequentially and time-divisionally drives the sixteenth nozzle N16 to the first nozzle N1 of the first nozzle group NG1 in a direction of arrow d. Since the printhead 111' moves in the main scanning direction (i.e., the y-direction) and ejects the ink droplets onto the stopped print medium P, ink dots 1B1 ejected onto the print medium P are formed along a slanted line having the predetermined slope. In addition, the controller 130 drives one of two blocks M1 and M2 of the second nozzle group NG2 and then drives the other block. Again, the first nozzle group NG1 and the second nozzle group NG2 may be driven simultaneously in one printing operation. In the present embodiment, the first block M1 is driven and then the second block M2 is driven. That is, the controller 130 sequentially drives the eighth nozzle L8 to the first nozzle L1 of the first block M1 in a direction of arrow e, and then sequentially drives the sixteenth nozzle L16 to the ninth nozzle L9 of the first block M1 in a direction of arrow f. Thus, ink dots 2B1 ejected onto the print medium P by the second block M2 and ink dots 2B2 ejected onto the print medium P by the first block M1 are formed along a slanted line having the predetermined slope. In this case, the controller 130 may drive the first nozzle group NG1 and the second nozzle group NG2 so that the ink dots 1B1 ejected by time-division driving of the first nozzle group NG1 and the ink dots 2B1 and 2B2 ejected by time-division driving of the second nozzle group NG2 form a slanted line having the same slope, as illustrated in FIG. 14. The controller 130 feeds the print medium P by the predetermined distance before printing to the next region and then repeatedly performs the above-described operations, thereby printing an image. If the first nozzle group NG1 and the second nozzle group NG2 are driven using the above-described operations, a difference in a deviation degree W produced by time-division driving can be visually minimized and the ink dots ejected by adjacent nozzles can be prevented from overlapping.

Figure 15A:
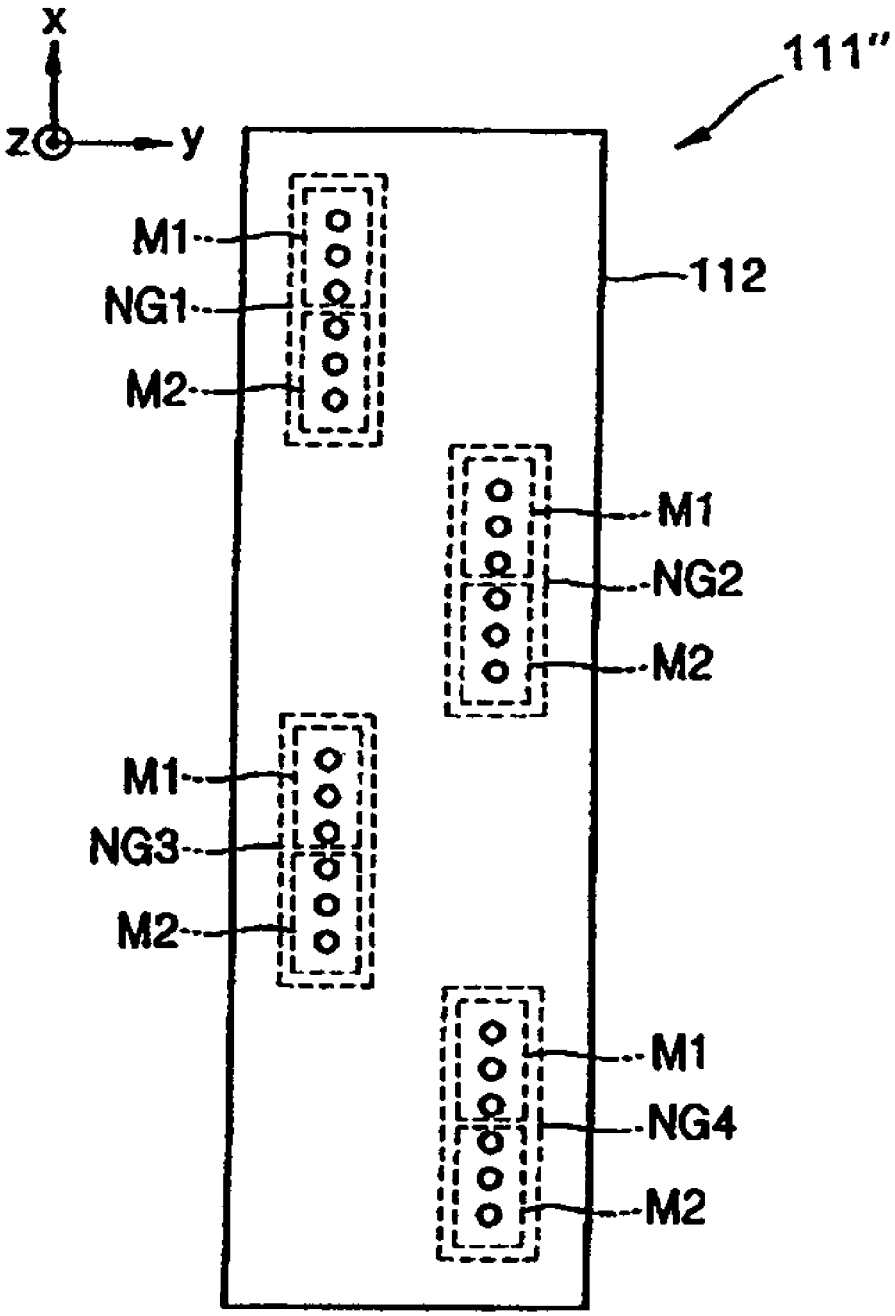
FIGS. 15A and 15B illustrate a printhead according to other embodiments of the present general inventive concept.
Figure 15B:
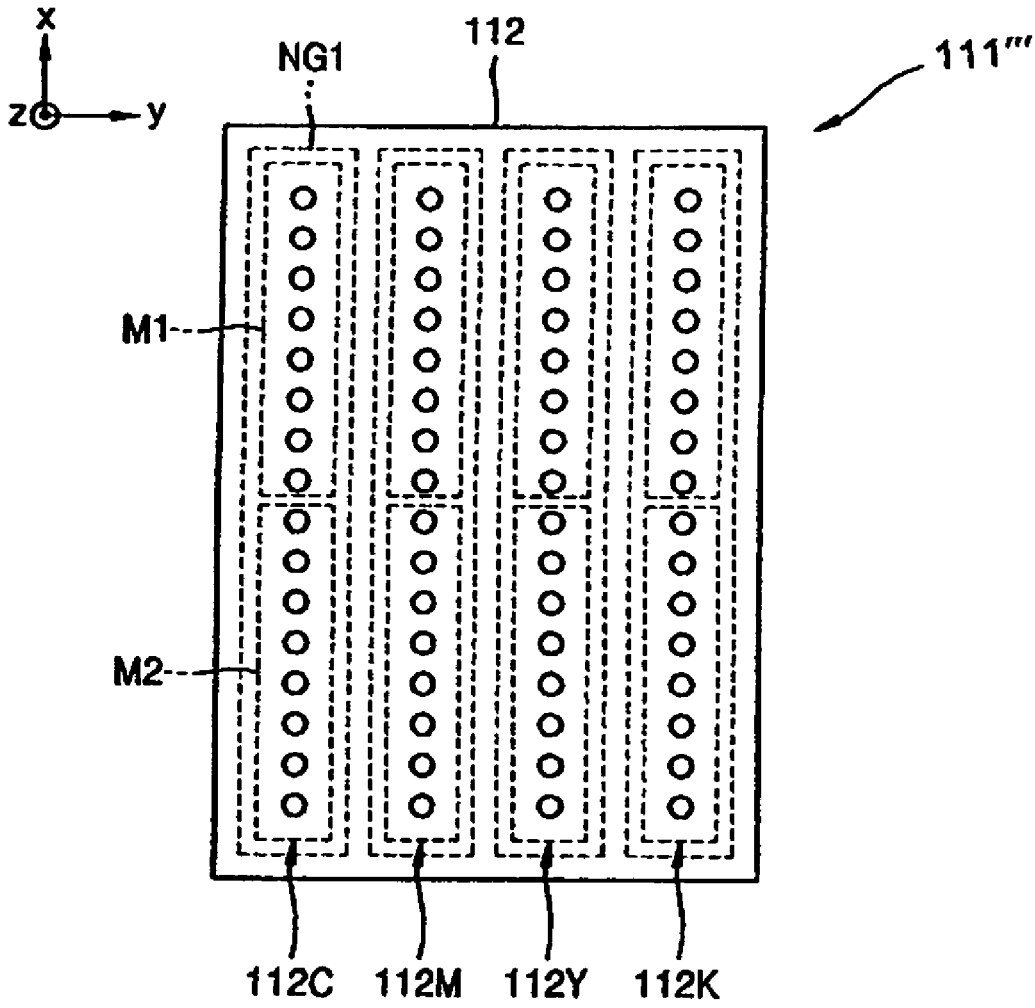

FIGS. 15A and 15B illustrate printheads 111" and 111'" according to other embodiments of the present general inventive concept. For illustration purposes, like reference numerals are used to refer to elements having the same functions as those elements illustrated in FIGS. 6 through 11. In the printhead 111" of FIG. 15A, four nozzle groups NG1, NG2, NG3, and NG4 are arranged in a zigzag pattern in the subsidiary scanning direction. In the printhead 111'" of FIG. 15B, nozzles of the nozzle group NG1 are disposed to be parallel in the subsidiary scanning direction. Here, reference numerals 112C, 112M, 112Y, and 112K represent nozzle rows to eject cyan, magenta, yellow, and black ink, respectively. It should be understood that arrangements of the nozzles in the printheads 111" and 111'" of FIGS. 15A and 15B are exemplary and are not intended to limit the scope of the present general inventive concept, and other arrangements may alternatively be used.

The embodiments of the present general inventive concept can be embodied as computer readable codes on a computer readable recording medium. The computer readable recording medium may include any data storage device that can store data which can be thereafter read by a computer system. Examples of the computer readable recording medium include a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. The embodiments of the present general inventive concept may also be embodied in hardware or a combination of hardware and software. For example, the controller 130 may be embodied in software, hardware, or a combination thereof.

According to the above-described structures and operations, a difference in a deviation degree produced by time-division driving can be visually minimized and ink dots ejected by adjacent nozzles can be prevented from overlapping.

As described above, in an inkjet image forming apparatus according to various embodiments of the present general inventive concept, nozzle groups and nozzle groups divided into blocks are time-divisionally driven in the same direction so that a difference in a deviation degree produced by time-division driving can be minimized and quality of a printed image can be improved. In addition, the nozzle groups and the nozzle groups divided into blocks are time-divisionally driven in the same direction such that a double-printed area or an unprinted area are not formed, and ink is uniformly ejected onto the print medium such that printing quality can be improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus, comprising:

a print head unit having a plurality of nozzles extending along a first axis thereof and to reciprocate over a print medium; and a controller to control the print head unit to perform a first printing operation to sequentially eject ink from the plurality of nozzles in a line in a first direction along the first axis, and to control the print head unit to perform a second printing operation to sequentially eject ink from at least a first block of the plurality of nozzles and at least a second block of the plurality of nozzles in the line in the first direction along the first axis, wherein the controller controls the print head unit to print from a first end thereof to a second end thereof during the first printing operation in the first direction, and controls the print head unit to print using the at least one first block which is disposed closest to the second end of the print head unit and then the at least one second block which is disposed close to the first end of the print head unit in the first direction.

2. The inkjet image forming apparatus of claim 1, wherein the controller controls the first printing operation while the print head unit reciprocates a first time over the print medium, and the controller controls the second printing operation while the print head unit reciprocates a second time over the print medium.

3. The inkjet image forming apparatus of claim 1, wherein the controller controls the print head unit to print to a print area two or more times.

4. The inkjet image forming apparatus of claim 1, wherein the print medium is stopped during the first and second printing operations.

5. The inkjet image forming apparatus of claim 1, wherein the print head unit comprises a plurality of head chips.

6. The inkjet image forming apparatus of claim 1, wherein the first printing operation corresponds to a first reciprocation over the print medium, and the second printing operation corresponds to a second reciprocation over the print medium.

7. An inkjet image forming apparatus, comprising:

a print head unit having a plurality of nozzles extending along a first axis thereof and to reciprocate over a print medium; and a controller to control the print head unit to perform a first printing operation to sequentially eject ink from the plurality of nozzles in a line in a first direction along the first axis, and to control the print head unit to perform a second printing operation to sequentially eject ink from at least a first block of the plurality of nozzles and at least a second block of the plurality of nozzles in the line in the first direction along the first axis, wherein the first print operation creates a first line having a predetermined slope at a first location on the print medium, and the second printing operation creates a second line having the predetermined slope on a first side of the first line and a third line having the predetermined slope on a second side of the first line.

8. An inkjet image forming apparatus, comprising:

a print head unit having a plurality of nozzles that are divisible into at least a first nozzle block and a second nozzle block extending along a first axis thereof and to reciprocate over a print medium; and a controller to control the print head unit to perform a first printing operation to sequentially eject ink from the first nozzle block and the second nozzle block in a line in a first direction along the first axis, and to control the print head unit to perform a second printing operation to sequentially eject ink from the second nozzle block and the first nozzle block in the line in the first direction along the first axis.

9. A method of controlling an inkjet image forming apparatus including a print head unit having a plurality of nozzles that are divisible into at least a first nozzle block and a second nozzle block extending along a first axis thereof and to reciprocate over a print medium, the method comprising:

controlling the print head unit to perform a first printing operation to sequentially eject ink from the first nozzle block and the second nozzle block in a line in a first direction along the first axis; and controlling the print head unit to perform a second printing operation to sequentially eject ink from the second nozzle block and the first nozzle block in the line in the first direction along the first axis.

* * * * *